US009102150B2

(12) United States Patent
Higuchi et al.

(10) Patent No.: US 9,102,150 B2
(45) Date of Patent: Aug. 11, 2015

(54) LIQUID EJECTION HEAD AND METHOD FOR MANUFACTURING SAME

(71) Applicant: CANON KABUSHIKI KAISHA, Tokyo (JP)

(72) Inventors: Hiroshi Higuchi, Atsugi (JP); Makoto Terui, Yokohama (JP); Masaya Uyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/330,984

(22) Filed: Jul. 14, 2014

(65) Prior Publication Data

US 2015/0022590 A1 Jan. 22, 2015

(30) Foreign Application Priority Data

Jul. 16, 2013 (JP) ..... 2013-147909

(51) Int. Cl.
*B41J 2/15* (2006.01)
*B41J 2/14* (2006.01)
*B41J 2/16* (2006.01)

(52) U.S. Cl.
CPC ..... *B41J 2/1433* (2013.01); *B41J 2/162* (2013.01); *B41J 2/1637* (2013.01)

(58) Field of Classification Search
None
See application file for complete search history.

(56) References Cited

U.S. PATENT DOCUMENTS

| | | | | |
|---|---|---|---|---|
| 6,569,343 | B1 * | 5/2003 | Suzuki et al. | 216/27 |
| 6,644,786 | B1 * | 11/2003 | Lebens | 347/54 |
| 7,517,051 | B2 * | 4/2009 | Kim et al. | 347/47 |
| 7,600,856 | B2 | 10/2009 | Lebens | |

* cited by examiner

*Primary Examiner* — Lamson Nguyen
(74) *Attorney, Agent, or Firm* — Canon USA Inc. IP Division

(57) ABSTRACT

A liquid ejection head includes a substrate, an energy-generating element provided on a front surface side of the substrate, the energy-generating element generating energy for ejecting liquid, sidewall members of a liquid flow path, and an ejection port forming member that defines an ejection port from which the liquid is ejected. In the liquid ejection head, sidewalls of the liquid flow path are formed of the sidewall members and a top wall of the liquid flow path is formed of the ejection port forming member, the sidewall members are each formed of a core member that extends from a front surface of the substrate and a covering member that covers the surface of the core member, the covering member covers the front surface of the substrate, and the ejection port forming member is formed of an inorganic material.

13 Claims, 3 Drawing Sheets

LIQUID EJECTION HEAD AND METHOD FOR MANUFACTURING SAME

BACKGROUND OF THE INVENTION

1. Field of the Invention

The present invention relates to a liquid ejection head and a method for manufacturing the same.

2. Description of the Related Art

A liquid ejection apparatus, a representative example of which is an ink jet recording device, includes a liquid ejection head that ejects liquid. A liquid ejection head typically includes a silicon substrate having energy-generating elements that generate energy to eject liquid and an ejection port forming member that defines ejection ports, from which liquid is ejected, on a front surface side of the silicon substrate.

Some ejection port forming members are formed of an organic material or an inorganic material. U.S. Pat. No. 7,600,856 discloses a liquid ejection head including an ejection port forming member formed of an inorganic material in which the ejection port forming member also serves as flow path wall members and in which the flow path wall members form liquid flow paths. The ejection port forming member and the flow path wall members are referred to as nozzle members. As is the case of the liquid ejection head disclosed in U.S. Pat. No. 7,600,856, when the nozzle members are formed of an inorganic material, swelling of the nozzle members with liquid can be advantageously suppressed.

The liquid ejection head disclosed in U.S. Pat. No. 7,600,856 is manufactured by the following processes. First, a resin and the like are coated on the substrate and patterning is carried out thereon such that a pattern-forming material for the liquid flow path is formed. Next, a layer of inorganic material is deposited by chemical vapor deposition (CVD) so as to cover the pattern-forming material. After that, ejection ports are formed in the deposited layer of the inorganic material, and, subsequently, the pattern-forming member is removed. The liquid ejection head in which the nozzle members are formed of an inorganic material is manufactured in the above manner.

SUMMARY OF THE INVENTION

The present invention is a liquid ejection head including a substrate, an energy-generating element provided on a front surface side of the substrate, the energy-generating element generating energy for ejecting liquid, sidewall members of a liquid flow path, and an ejection port forming member that defines an ejection port from which the liquid is ejected. In the liquid ejection head, sidewalls of the liquid flow path are formed of the sidewall members and a top wall of the liquid flow path is formed of the ejection port forming member, the sidewall members are each formed of a core member that extends from a front surface of the substrate and a covering member that covers the surface of the core member, the covering member covers the front surface of the substrate, and the ejection port forming member is formed of an inorganic material.

Further features of the present invention will become apparent from the following description of exemplary embodiments with reference to the attached drawings.

DESCRIPTION OF THE EMBODIMENTS

In the liquid ejection head disclosed in U.S. Pat. No. 7,600,856, the portions where nozzle members and a substrate are in contact with one another are limited to portions mainly between liquid flow paths. Accordingly, there are cases in which the nozzle members peel off from the substrate due to a decrease in adhesion between the nozzle members and the substrate.

Figure 3A:
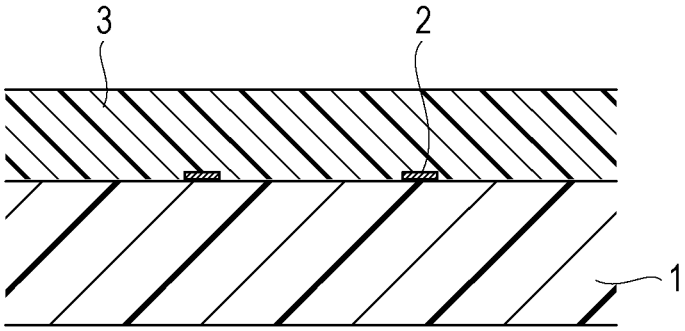
FIGS. 3A to 3C are diagrams illustrating an example of a method for manufacturing a liquid ejection head.
Figure 3B:
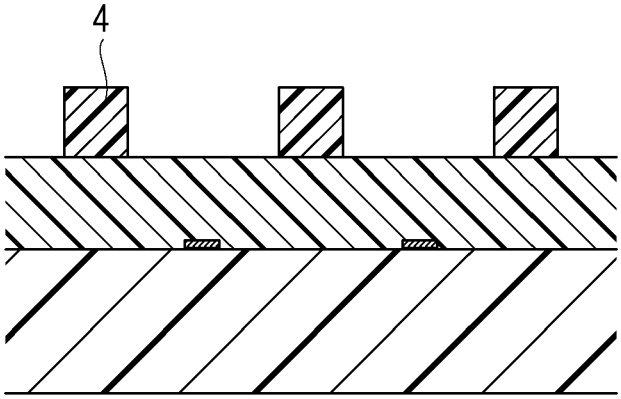
Figure 3C:
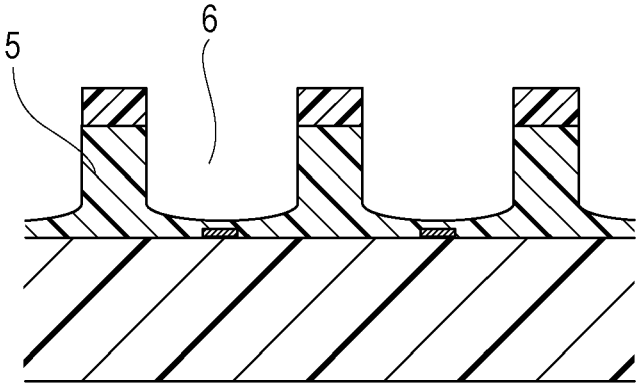

In order to improve the adhesion between the nozzle members and the substrate in such a liquid ejection head, the contact area between the nozzle members and the substrate needs to be increased. A method for manufacturing the liquid ejection head that is illustrated in FIGS. 3A to 3C, for example, can be considered as a method for increasing the contact area between the nozzle members and the substrate. As illustrated in FIG. 3A, a film composed of an inorganic material 3 is first deposited by CVD on a front surface of a substrate 1 that includes energy-generating elements 2. Next, as illustrated in FIG. 3B, resists 4 composed of resin or the like are formed on the front surface of the inorganic material 3. Next as illustrated in FIG. 3C, with the resists 4 serving as masks, the inorganic material 3 is etched by dry etching or the like to form flow path wall members 5 with the remaining inorganic material. Liquid flow paths 6 are formed between adjacent flow path wall members 5. Then, the resists 4 are removed and the ejection port forming member is formed above the flow path wall members 5.

It is considered that the method illustrated in FIGS. 3A to 3C allows the contact area between the nozzle members (the flow path wall members 6) and the substrate 1 to be increased and, thus, the adhesion therebetween is increased.

Generally, the liquid flow paths 6 each need a few micrometers or more in height. Accordingly, the film of the inorganic material is formed to have such a height (a thickness) and etching is performed; however, in such a case, a problem is encountered in that the manufacturing time becomes significantly long leading to reduction in productivity. Furthermore, since the height and the profile of the flow paths are controlled through dry etching, accuracy becomes an issue as well.

Therefore, the present invention provides a liquid ejection head that has high adhesion between the nozzle members and the substrate and that can be manufactured readily, and a method for manufacturing the liquid ejection head.

Hereinafter, an example of the liquid ejection head and an example of the method for manufacturing the liquid ejection head of the present invention will be described with reference to the drawings.

Figure 1A:
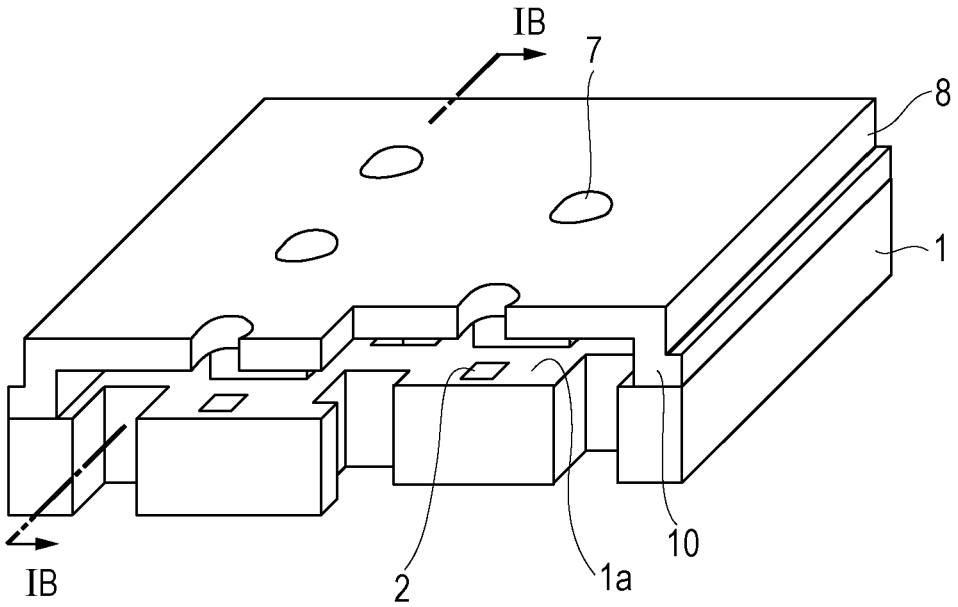
FIGS. 1A and 1B are diagrams illustrating an example of a liquid ejection head of the present invention.
Figure 1B:
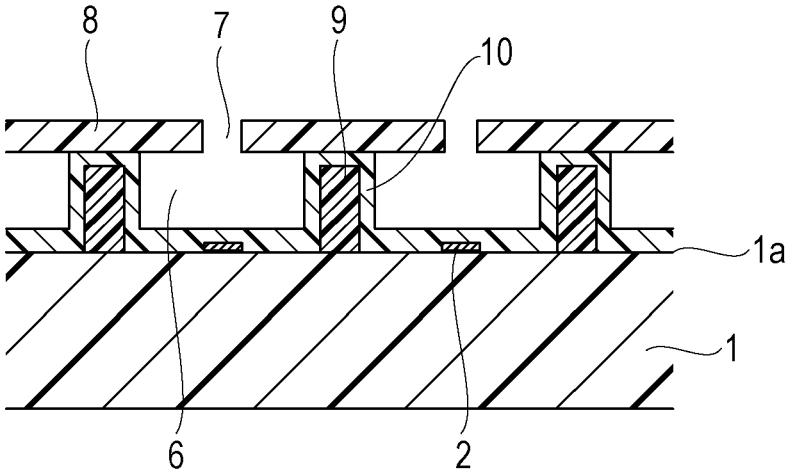

FIGS. 1A and 1B are diagrams illustrating an example of the liquid ejection head of the present invention. FIG. 1A is a perspective view of the liquid ejection head, and FIG. 1B is a diagram illustrating a cross-section of the liquid ejection head taken along the broken line IB-IB of FIG. 1A.

The liquid ejection head illustrated in FIG. 1A includes a substrate 1, energy-generating elements 2 that are provided on a front surface 1*a* side of the substrate 1 and that generate energy for ejecting liquid, sidewall members of liquid flow paths 6, and an ejection port forming member 8 in which ejection ports 7, from which liquid is ejected, are formed. The sidewall members are formed by core members 9 and a covering member 10. A plurality of core members 9 are formed on the front surface 1*a* side of the substrate 1 so as to extend from the front surface 1*a* of the substrate 1. The surfaces of the core members 9 are covered by the covering member 10. Furthermore, the front surface 1*a* of the substrate 1 is also covered by the covering member 10.

The liquid flow paths 6 are formed in areas between adjacent core members 9 in the plurality of core members 9. Sidewalls of the liquid flow paths 6 are formed by the core members 9 and the covering member 10 that are sidewall members, and the top walls of the liquid flow paths 6 are formed by the ejection port forming member 8. Furthermore, the bottom of each of the liquid flow paths 6 is formed by the covering member 10. Referring to FIG. 1B, the liquid flow paths 6 are each a chamber corresponding to the associated ejection port 7 and energy-generating element 2 and are each a chamber (a pressure chamber) in which the liquid is provided with energy from the energy-generating element 2.

It is preferable that a silicon substrate formed of silicon be used for the substrate 1. In particular, the silicon substrate is preferably a silicon substrate in which the crystal orientation of the front surface 1*a* is (100).

The energy-generating elements 2 are formed on the front surface 1*a* side of the substrate 1. The energy-generating elements 2 may be, for example, heating resistors, piezoelectric bodies, or actuators that are heated and deformed. The energy-generating elements 2 may be formed so as to be in contact with the front surface 1*a* of the substrate 1 or may be formed so as to be suspended over the front surface 1*a*. Other than the energy-generating elements 2, wiring for supplying electric power to the energy-generating elements 2, a logic circuit to selectively drive each of the energy-generating elements 2, a driver, an insulation film, a protective film, and the like may be formed on the front surface 1*a* side of the substrate 1.

The plurality of core members 9 are provided so as to extend from the front surface 1*a* of the substrate 1. In FIG. 1B, the core members 9 are provided so as to extend in a perpendicular direction with respect to the front surface 1*a* of the substrate 1. The core members 9 are preferably formed of a material that is suitable for patterning during the semiconductor processing (application, deposition, exposure/development, etching, and the like) and that is less likely to be deformed or decomposed during the formation process of the covering member 10 covering the core members 9. In particular, when the covering member 10 is formed (deposited) by CVD that requires a process temperature of a few hundred degrees, in order to secure shape stability during the deposition process, it is preferable that the core members 9 be formed of a material that has a glass transition temperature and a decomposition temperature that are higher than the process temperature of the CVD. The core members 9 may be formed of, for example, novolac resin, polyimide, polyetheretherketone, polyamide, polyamide-imide, polyether amide, polyether imide, epoxy resin, polyphenylene sulfide, polyarylate, polysulfone, polyethersulfone, and/or polybenzimidazole. In particular, polyimide is preferably used. The core members 9 are formed so that they do not cover the energy-generating elements 2 when the substrate 1 is viewed from above the front surface 1*a*. Accordingly, the maximum width of each core member 9 preferably ranges from 5 μm or more to 25 μm or less when the substrate 1 is seen from above the front surface 1*a*. Furthermore, the height of each core member 9 may be set in accordance with the ejection design (refill frequency and ejection amount) of the liquid ejection head. The height of each core member 9 preferably ranges from 1 μm or more to 75 μm or less from the front surface 1*a* of the substrate 1.

The covering member 10 is formed so as to cover the plurality of core members 9 and the front surface 1*a* of the substrate 1. In FIG. 1B, the covering member 10 covers the sidewall members (the left and right walls in FIG. 1B) and the top wall portions (the upper walls in FIG. 1B) of the core members 9. Furthermore, the covering member 10 covers the front surface 1*a* of the substrate 1 and the energy-generating elements 2. In the covering member 10, the portions that cover the core members 9 and the portions that cover the front surface 1*a* of the substrate 1 are formed continuously. As described above, since the portions covering the core members 9 and the portions covering the front surface 1*a* of the substrate 1 are formed continuously, adhesion between the covering member 10, which constitutes the nozzle members, and the substrate 1 can be further increased. The covering member 10 is preferably formed of a material that is less likely to swell and deform upon contact with liquid, such as ink and the like, and that has high adhesion with the front surface 1*a* of the substrate 1. Such a material may be, for example, at least one of silicon-based inorganic materials, such as silicon nitride (SiN), silicon oxide ($SiO_2$), silicon carbide (SiC), and silicon carbonitride (SiCN). In particular, since mechanical strength is improved, it is preferable to use at least one organic material for the core members 9 and at least one inorganic material for the covering member 10 such that the flow path wall members are composite structures of organic and inorganic materials. The thickness of the covering member 10 is preferably a thickness that creates no pinholes or the like in the portions where the core members 9 and the front surface 1*a* are in contact with each other in order to prevent liquid, such as ink or the like, from making contact with the core members 9. Specifically, the thickness of the covering member 10 is preferably 0.1 μm or more. While there are no upper limits in particular, considering the size of the liquid ejection head, the thickness is preferably 10.0 μm or less.

When the covering member 10 covers the energy-generating elements 2, the covering member 10 may be utilized as a protective film and/or an insulation film of the energy-generating elements 2. On the other hand, the covering member 10 does not need to cover the energy-generating elements 2. In such a case, the covering member 10 that is on the energy-generating elements 2 is removed. Even if the covering member 10 does not cover the energy-generating elements 2, sufficient contact area between the nozzle layer and the front surface 1*a* of the substrate 1 is obtained; accordingly, a preferable adhesive force can be generated.

Furthermore, the covering member 10 can be discontinuous at portions above the top wall portion of each core member 9. In other words, the covering member 10 does not have to cover at least a portion of the top wall portion of each core member 9. As will be described later, when the upper portion is discontinuous, the height distribution accuracy of the flow paths can be increased.

The ejection port forming member 8 is a member that defines the ejection ports 7. The ejection port forming member 8 is disposed on the front surface 1*a* side of the substrate 1. The ejection port forming member 8 defines the top walls of the liquid flow paths 6. Furthermore, the ejection port forming member 8 is in contact with the portions of the covering member 10 that cover the top wall portions of the core members 9. The ejection port forming member 8 is formed of at least one inorganic material. The inorganic material may be at least one of silicon-based inorganic materials, such as silicon nitride (SiN), silicon oxide ($SiO_2$), silicon carbide (SiC), silicon carbonitride (SiCN). In order to increase the adhesion between the covering member 10, the ejection port forming member 8 is preferably formed of a material that is of the same type as that of the covering member 10. For example, when the covering member 10 is formed of SiN, the ejection port forming member 8 is formed of SiN as well. The same type does not necessarily mean that the molecular weight, the physical properties, and the like are the same.

Note that the ejection port forming member 8 and the covering member 10 may have a multilayer structure formed of different types of materials or may have a gradient membrane structure in which the composition ratio changes continuously. With such a structure, improvement of mechanical strength and workability can be achieved. By treating the surfaces of the ejection port forming member 8 and covering member 10, wettability to liquid may be controlled.

If no covering member 10 is present at the top wall portions of the core members 9, the core members 9 and the ejection port forming member 8 will be in direct contact with each other in the area where there is no covering member 10. On the other hand, if the covering member 10 is present at the top wall portions of the core members 9, the top wall portions of the core members 9 and the ejection port forming member 8 will not be in direct contact with each other in the area where the covering member 10 exists; accordingly, the ejection port forming member 8 will have a covering member 10 between itself and the top wall portions of the core members 9.

An exemplary method for manufacturing the exemplary liquid ejection head of the present invention will be described next. FIGS. 2A to 2E are diagrams illustrating an example of the method for manufacturing the liquid ejection head of the present invention and are cross-sectional views of the portions similar to that of FIG. 1B.

Figure 2A:
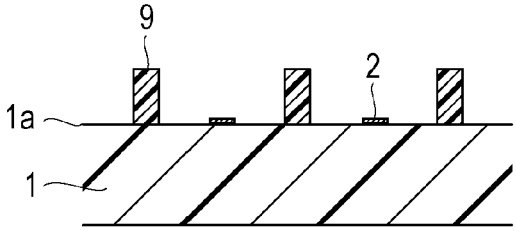
FIGS. 2A to 2E are diagrams illustrating an example of a method for manufacturing the liquid ejection head of the present invention.

First, as illustrated in FIG. 2A, the substrate 1 having the energy-generating elements 2 on the front surface 1*a* side is prepared. Then, the plurality of core members 9 are formed on the front surface 1*a* side of the substrate 1. The core members 9 are formed, for example, by coating a photosensitive material on the front surface 1*a* of the substrate 1 and by performing patterning by photolithography. If the core members 9 are formed with a non-photosensitive material, for example, a non-photosensitive material is coated on the front surface 1*a* of the substrate 1, resists are formed thereon, and the non-photosensitive material is patterned with the resists serving as masks. Other than the above patterning method, according to the required dimensional accuracy or size, the pattern can be formed by various patterning methods such as printing that directly forms the pattern or nano-printing.

Figures 1, 2B:
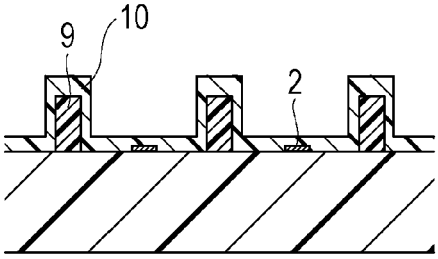
Figures 2, 2B:
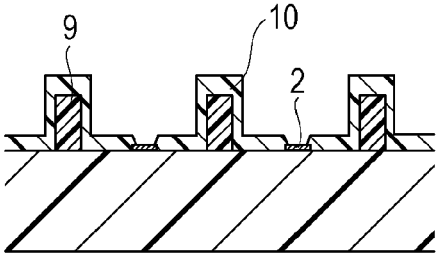

Next, as illustrated in FIG. 2B-1, the covering member 10 is formed. The covering member 10 is deposited, for example, by chemical vapor deposition (CVD) so as to cover the front surface 1*a* of the substrate 1 and the core members 9. The core members 9 and the covering member 10 become the sidewall members that form the sidewalls of the liquid flow paths 6. The covering member 10 needs to have a thickness (film thickness) that sufficiently covers the core members 9 and the front surface 1*a* of the substrate 1, and the thickness needs to be set while considering the strength of the covering member 10 together with the core members 9 serving as sidewalls of the liquid flow paths 6. Furthermore, if the covering member 10 is to serve as a protective layer or the like of the energy-generating elements 2 as well, and, for example, if the energy-generating elements 2 are heating resistors, the thickness is to be determined comprehensively while considering the ejection performance of the liquid as well. While the covering member 10 covers the energy-generating elements 2 in FIG. 2B-1, as illustrated in FIG. 2B-2, the covering member 10 may be configured such that none of the upper surfaces of the energy-generating elements 2 are covered.

Next, the ejection port forming member 8 is formed over the sidewall members. As a method for forming the ejection port forming member 8, there is a method in which, in the state illustrated in FIG. 2B-1 or 2B-2, a dry film is stacked and is made to come in contact with portions of the covering member 10 above the top wall portions of the core members 9. In such a case, by forming ejection ports 7 in the dry film, the dry film becomes the ejection port forming member 8. The ejection port forming member 8 may be formed with the above method; however, a method that allows the shape and size of the flow paths to be controlled more easily will be described next.

Figure 2C:
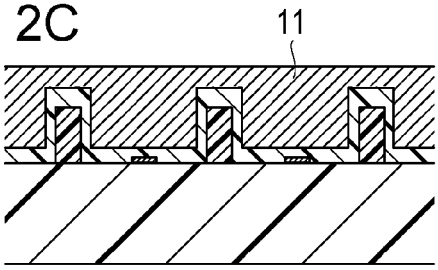

First, as illustrated in FIG. 2C, the areas between the plurality of core members 9 are filled with a filling material 11 that will be removed later. It is preferable that the filling material 11 fills the area between the core members 9 sufficiently, and when considering the process margin, it is preferable that the filling material 11 covers the top wall portions of the covering member 10 as well. In other words, it is preferable that the filling material 11 is applied so that it fills the areas between the plurality of core members 9 and covers the top wall portions of the covering member 10.

The filling material 11 is removed later; accordingly, at least some portions of the removed portions become the liquid flow paths 6. Accordingly, the filling material 11 is preferably formed of a material that can be easily removed and that has high compatibility (heat resistance, coefficient of linear expansion, solubility, and the like) with the following process and with the covering member 10. For example, in the case of an organic material, the filling material 11 may be, for example, polyimide or other resins, and in the case of a metal material, the filling material may be, for example, aluminum or an aluminum alloy. Note that when the filling material 11 is an organic material, it can be removed, for example, by dry etching using oxygen radicals or by wet removal with a solvent. When the filling material 11 is a metal material, it can be removed, for example, by wet etching using phosphoric nitric acid.

Figures 1, 2D:
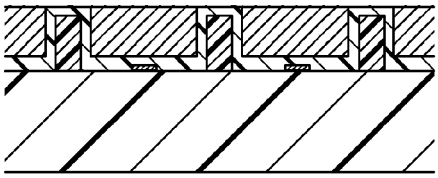
Figures 2, 2D:
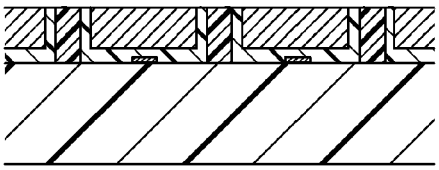

Next, as illustrated in FIG. 2D-1, the filling material 11 is removed such that the covering member 10 covering the top wall portions of the core members 9 is exposed. A method such as etchback or chemical mechanical polishing (CMP) may be used to remove the filling material 11. In particular, CMP is preferable since CMP can planarize the surface of the filling material 11 more easily.

Removal of the filling material 11 is performed until the covering member 10 becomes exposed. The ending point of the removal, in other words, the exposure of the covering member 10 can be identified by a method such as a static capacitor method that monitors the film thickness, an optical method, or the like. In order to reliably expose the covering member 10, the exposure is preferably detected by a torque detection method that detects the change in torque of the wafer carrier. Since torque changes with exposure of the covering member 10, the exposure of the covering member 10 can be detected by detecting the change in torque.

The removal of the filling material 11 may be continued further until, as illustrated in FIG. 2D-2, the top wall portions of the core members 9 become exposed. With the above, the in-plane distribution of the heights of the flow paths becomes preferable. This is because, variation in the deposition distribution of the covering member 10 is suppressed and the height variation of the flow paths is practically defined by the processing tolerance of the core members 9. The exposure of the top wall portions of the core members 9 can be detected by the change in torque caused by exposure of the top wall portions of the core members 9.

Figure 2E:
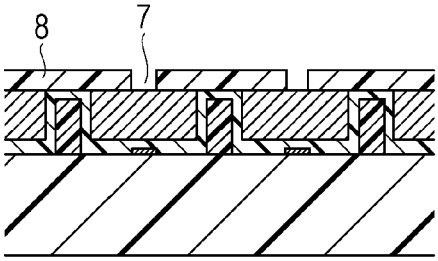

Next, as illustrated in FIG. 2E, the ejection port forming member 8 that defines the ejection ports 7 is formed. The ejection port forming member 8 is formed of at least one inorganic material. The ejection port forming member 8 is preferably formed by depositing an inorganic film by CVD and then by performing dry etching (reactive ion etching), with the resists serving as masks, such that ejection ports 7 are formed.

Next, the filling material 11 is removed. At this point, the portions where the filling material 11 has been removed become the liquid flow paths 6. The removal of the filling material 11 is performed using a dry or wet process depending on the material of the filling material 11. Furthermore, a liquid supply port is formed in the substrate 1 as required. The liquid supply port may be formed, for example, prior to the formation of the ejection port forming member 8.

The liquid ejection head illustrated in FIG. 1A can be manufactured in the above manner.

EXAMPLES

Hereinafter, examples of the liquid ejection head and method for manufacturing the liquid ejection head of the present invention will be described.

Example 1

A substrate 1 that has energy-generating elements 2 on a front surface 1*a* side thereof was prepared first. A silicon substrate in which the crystal orientation of the front surface 1*a* is (100) was employed as the substrate 1. Heating resistors formed of TaSiN was employed as the energy-generating elements 2. A plurality of core members 9 were formed on the front surface 1*a* side of the substrate 1. The formation of the core members 9 was carried out in the following manner. First, a non-photosensitive polyimide (product name: PI2611, manufactured by HD MicroSystems, Ltd.) was spin-coated on the front surface 1*a* side of the substrate 1. Next, a positive resist (product name: iP5700, manufactured by TOKYO OHKA KOGYO CO., LTD.) was coated over the polyimide. Then the resist was exposed, and the resist and the polyimide were developed simultaneously with an alkaline solution. After the resist was stripped off, baking was carried out in an oven to perform dehydration condensation; accordingly, the core members 9 formed of polyimide was formed (FIG. 2A). Note that the glass transition temperature of the polyimide employed for the core members 9 was 400° C. The core members 9 were formed so as not to cover the energy-generating elements 2 when seen from above the front surface 1*a* of the substrate 1, and the maximum width of each core member 9 was 10 μm. The height of each core member 9 was 20 μm from the front surface 1*a* of the substrate 1.

Next, a SiN film that covers the core members 9 was deposited by CVD with monosilane gas and nitrogen gas as the source gases at a process temperature of 350° C.; accordingly, the covering member 10 was formed (FIG. 2B-1). As illustrated in FIG. 2B-1, the covering member 10 was formed so as to cover, in addition to the core members 9 and the front surface 1*a* of the substrate 1, the energy-generating elements 2 as well. The thickness of the covering member 10 was 1.0 μm.

Next, the non-photosensitive polyimide (product name: PI2611, manufactured by HD MicroSystems, Ltd.) was spin-coated on the core members 9 so as to cover the core members 9. Then, baking was carried out in an oven to perform dehydration condensation; accordingly, areas between the plurality of core members 9 were filled with a filling material 11 composed of polyimide (FIG. 2C).

Next, the filling material 11 was removed by CMP such that the covering member 10 covering the top wall portions of the core members 9 were exposed and such that the surface of the filling material 11 was planarized (FIG. 2D-1). During the above process, the endpoint of the CMP was identified by detecting the change in torque of a wafer carrier that is caused by exposure of the covering member 10.

Next, a SiN film that covers the covering member 10, which covers the top wall portions of the core members 9, and that covers the surface of the filling material 11 was deposited by CVD with monosilane gas and nitrogen gas as the source gases at a temperature of 350° C. Then, a positive resist (product name: iP5700, manufactured by TOKYO OHKA KOGYO CO., LTD.) was coated over the upper surface of the deposited SiN film, was exposed, and was developed such that a mask was formed. After that, reactive ion etching was performed on the SiN film using the mask that had been formed; accordingly, ejection ports 7 were formed in the SiN film. Finally, the resist was removed and the ejection port forming member 8 was formed (FIG. 2E). The ejection port forming member 8 was configured to have the covering member 10 between itself and the top wall portions of the core members 9.

After the above, while the ejection port forming member 8 was protected by a cyclorubber (product name: OBC, manufactured by TOKYO OHKA KOGYO CO., LTD.), a liquid supply port was formed in the substrate 1 with a TMAH solution of 22 mass %. After that, the cyclorubber was removed and the filling material 11 was decomposed and removed by dry etching using oxygen radicals serving as a reactant gas; accordingly, the liquid ejection head was manufactured.

The manufactured liquid ejection head was dipped in ink with the following composition and was preserved for three months under a constant temperature of 80° C.

| | |
|---|---|
| CABOJET 300 (manufactured by Cabot Corporation, a self-dispersion pigment) | 3.0 parts by mass |
| glycerin | 5.0 parts by mass |
| diethylene glycol | 5.0 parts by mass |
| Acetylenol E100 (manufactured by Kawaken Fine Chemicals Co., Ltd., a surfacant) | 0.2 parts by mass |
| water | 86.8 parts by mass |

After that, an inspection for peeling off of the nozzle layer (the core members 9, the covering member 10, and the ejection port forming member 8) and the liquid ejection head from the substrate 1 was conducted with a microscope; no peeling off was identified.

Example 2

Processes until a process in which a covering member 10 is formed by depositing a SiN film that covers core members 9 by CVD (FIG. 2B-1) were similar to that of Example 1.

After the above, a positive resist (product name: iP5700, manufactured by TOKYO OHKA KOGYO CO., LTD.) was spin coated, and exposure and development were subsequently carried out so as to form a mask that has patterns that open the covering member 10 above energy-generating elements 2. Next, isotropic chemical dry etching (CDE) was performed with fluorine radicals and oxygen radicals serving as reactant gases so as to selectively remove the covering member 10 above the energy-generating elements 2. After that, wet stripping was carried out on the mask so as to remove the covering member 10 on the upper surfaces of the energy-generating elements 2 (FIG. 2B-2). In other words, the covering member 10 was configures so as not to coat the energy-generating elements 2.

Then, the liquid ejection head was manufactured in the same manner as that of Example 1.

The manufactured liquid ejection head was preserved in ink under a constant temperature similar to that of Example 1, and an inspection for peeling off of the nozzle layer (the core members 9, the covering member 10, and the ejection port forming member 8) and the liquid ejection head from the substrate 1 was conducted with a microscope; no peeling off was identified.

Furthermore, the liquid ejection head was mounted in an ink jet recording device, and the ejection of liquid was checked. As a result, it was confirmed that the liquid ejection head was capable of ejecting liquid with smaller energy compared to that of the liquid ejection head of Example 1.

Example 3

Processes until a process in which areas between a plurality of core members 9 are filled with a filling material 11 composed of polyimide (FIG. 2C) were similar to that of Example 1.

Then, the filling material 11 was removed by CMP. While the filling material 11 was removed until the top wall portions of the core members 9 were exposed, the surface of the filling material 11 was planarized at the same time (FIG. 2D-2). During this process, the change in torque of the wafer carrier was detected, and the endpoint of the removal was when the second torque change occurred. As a result, the top wall portions of the core members 9 were exposed.

After the above, the liquid ejection head was manufactured in the same manner as that of Example 1. The ejection port forming member 8 was configured to be in contact with the top wall portions of the core members 9.

The manufactured liquid ejection head was preserved in ink under a constant temperature similar to that of Example 1, and an inspection for peeling off of the nozzle layer (the core members 9, the covering member 10, and the ejection port forming member 8) and the liquid ejection head from the substrate 1 was conducted with a microscope; no peeling off was identified.

Furthermore, the liquid ejection head was mounted in an ink jet recording device, and the ejection of liquid was checked. As a result, it was confirmed that the liquid ejection head had a higher ejection precision compared to that of the liquid ejection head of Example 1.

The present invention can provide a liquid ejection head that has high adhesion between the nozzle members and the substrate and that can be manufactured readily and a method for manufacturing the liquid ejection head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-147909, filed Jul. 16, 2013, which is hereby incorporated by reference herein in its entirety.

What is claimed is:

1. A liquid ejection head, comprising:

a substrate;

an energy-generating element provided on a front surface side of the substrate, the energy-generating element generating energy for ejecting liquid;

sidewall members of a liquid flow path; and an ejection port forming member that defines an ejection port from which the liquid is ejected, wherein sidewalls of the liquid flow path are formed of the sidewall members and a top wall of the liquid flow path is formed of the ejection port forming member, the sidewall members are each formed of a core member that extends from a front surface of the substrate and a covering member that covers the surface of the core member, the covering member covers the front surface of the substrate, and the ejection port forming member is formed of an inorganic material.

2. The liquid ejection head according to claim 1, wherein the core member is formed of at least one of novolac resin, polyimide, polyetheretherketone, polyamide, polyamide-imide, polyether amide, polyether imide, epoxy resin, polyphenylene sulfide, polyarylate, polysulfone, polyethersulfone, and polybenzimidazole.

3. The liquid ejection head according to claim 1, wherein the covering member is formed of at least one of silicon nitride, silicon oxide, silicon carbide, and silicon carbonitride.

4. The liquid ejection head according to claim 1, wherein the ejection port forming member is formed of at least one of silicon nitride, silicon oxide, silicon carbide, and silicon carbonitride.

5. The liquid ejection head according to claim 1, wherein a bottom of the liquid flow path is formed by the covering member.

6. The liquid ejection head according to claim 1, wherein the covering member covers the energy-generating element.

7. The liquid ejection head according to claim 1, wherein the covering member does not cover the energy-generating element.

8. The liquid ejection head according to claim 1, wherein the ejection port forming member is in contact with a top wall portion of the core member.

9. The liquid ejection head according to claim 1, wherein the ejection port forming member and a top wall portion of the core member have the covering member in between.

10. A method for manufacturing the liquid ejection head according to claim 1, the method comprising:

preparing a substrate that has an energy-generating element on a front surface side thereof;

forming a plurality of core members on the front surface side of the substrate;

covering a front surface of the substrate and the core members with a covering member;

applying a filling material that fills an area between the plurality of core members and that covers top wall portions of the covering member;

removing the filling material at least until the covering member becomes exposed; and forming an ejection port forming member.

11. The method for manufacturing the liquid ejection head according to claim 10, wherein a detection of exposure of the covering member is performed by a torque detection method that detects a change in torque that is caused by exposure of the covering member.

12. The method for manufacturing the liquid ejection head according to claim 10, wherein the removing of the filling material is performed until top wall portions of the core members become exposed.

13. The method for manufacturing the liquid ejection head according to claim 12, wherein a detection of exposure of the top wall portions of the core members is performed by a torque detection method that detects the change in torque that is caused by exposure of the top wall portions of the core members.

* * * * *